US006646532B2

(12) United States Patent
Fujiwara et al.

(10) Patent No.: US 6,646,532 B2
(45) Date of Patent: Nov. 11, 2003

(54) POWDER CORE AND REACTOR USING THE SAME

(75) Inventors: Teruhiko Fujiwara, Sendai (JP); Masayoshi Ishii, Sendai (JP); Yoshitaka Saito, Sendai (JP)

(73) Assignee: NEC Tokin Corporation, Sendai (JP)

( * ) Notice: Subject to any disclaimer, the term of this patent is extended or adjusted under 35 U.S.C. 154(b) by 48 days.

(21) Appl. No.: 10/084,539

(22) Filed: Feb. 26, 2002

(65) Prior Publication Data

US 2003/0160677 A1 Aug. 28, 2003

(51) Int. Cl.[7] ..... H01F 27/02
(52) U.S. Cl. ..... 336/96; 148/306; 148/104
(58) Field of Search ..... 148/306, 104, 148/310, 307, 105; 252/62.54; 336/83, 96

(56) References Cited

U.S. PATENT DOCUMENTS 6,321,531 B1 * 11/2001 Caren et al. ..... 60/275
6,432,159 B1 * 8/2002 Saito et al. ..... 75/255

FOREIGN PATENT DOCUMENTS

| | | | |
|---|---|---|---|
| EP | 0 383 035 A | | 8/1990 |
| JP | 2-290002 A | | 11/1990 |
| JP | 403291305 A | * | 10/1991 |
| JP | 411204322 A | * | 7/1999 |

* cited by examiner

*Primary Examiner*—Anh Mai
(74) *Attorney, Agent, or Firm*—Frishauf, Holtz, Goodman & Chick, P.C.

(57) ABSTRACT

Preparation is made of alloy powder comprising 3.0–8.0 wt % Si, 0.1–1.0 wt % O, 0–2.0 wt % (0 being exclusive) of at least one element selected from Mn, Al, V, Cr, and Ti, and balance Fe and having a particle size substantially equal to 150 $\mu$m or less. A binder is mixed with the alloy powder to form a mixture. The mixture is compaction-formed by the use of a die. Thus, a powder core is obtained which has a 20 kHz a.c. permeability equal to 20 or more under an applied d.c. magnetic field of 12000 A/m, a core loss characteristic of 1000 kW/m$^3$ under the conditions of 20 kHz and 0.1 T, saturation magnetization of 10000 G or more, and coercive force of 3.0 Oe or less.

7 Claims, 4 Drawing Sheets

POWDER CORE AND REACTOR USING THE SAME

BACKGROUND OF THE INVENTION

This invention relates to a reactor adapted to be mounted to a switching power supply and a powder core suitable for use in the reactor.

In recent years, energy saving and global warming resulting from the increase in $CO_2$ emission are growing into important issues. In view of the above, energy saving technology is rapidly developed with respect to domestic electrical appliances and industrial apparatuses. Generally, motor-driven products, such as an air conditioner and a refrigerator, and lighting appliances are large in power consumption and are therefore given priority in development of the energy saving technology.

In order to improve the energy saving effect in those products, it is required to use a high-efficiency motor and to increase the efficiency of an electric circuit. In the electric circuit, the problem of efficiency resides in a power supply section for converting an a.c. input of 50/60 Hz into a d.c. output. In order to improve the efficiency, a switching power supply is recently and rapidly wide spread in the industrial apparatuses and the domestic electric appliances.

However, if the switching power supply is used, there arises a problem of generation of a harmonic current due to waveform distortion of electric current. In order to avoid the above-mentioned problem, proposal has been made of various circuit systems, for example, a choke input system, a single-transistor converter system, and an active filter system. In either system, a reactor is used to widen a conductive angle of the electric current.

Such reactor is required to have a wide variety of characteristics, such as a desired inductance value, a high conversion efficiency, no beat in an audible region, little temperature elevation, reduction in size and weight, and low cost. Various methods are available to individually and independently achieve each of the above-mentioned characteristics. On the other hand, in order to simultaneously and collectively achieve all of the above-mentioned characteristics, it is most effective to increase a switching frequency of the switching power supply to a high level, for example, 10 kHz or more. In this event, the reactor must be made of a material exhibiting low loss even at a relatively high frequency and having high permeability at a rated current.

In fact, it is well known that commercialization of a ferrite material for use at a high frequency greatly contributes to improvement of a small-capacity switching power supply operable at a high frequency as the switching frequency.

On the other hand, if the reactor is used in a large-capacity switching power supply, d.c. superposition characteristics are important in addition to the above-mentioned characteristics. Therefore, the ferrite material low in saturation magnetization can not be used but a different material must be used for the reactor. However, an ordinary silicon steel plate exhibits high core loss at a high frequency. Even a high silicon steel plate suffers a drastic increase in core loss and considerable deterioration in permeability at a frequency higher than 20 kHz. Therefore, a used frequency as the switching frequency is limited to 20 kHz or less. On the other hand, an amorphous material is high in cost because expensive boron is used and a special production facility is required. In addition, generation of beat in the audible region is inevitable because of large magnetostriction. Therefore, the amorphous material is not an optimum material.

In comparison, a powder core is excellent in frequency characteristics. As a disadvantage, an initial permeability is low. However, it is known that, by lowering the initial permeability, the powder core is excellent in d.c. superposition characteristics, specifically, in permeability at an applied d.c. magnetic field around 4000 A/m and that the core loss is relatively low. However, the d.c. superposition characteristics required for the reactor are under a high magnetic field around 12000 A/m. Furthermore, the core loss characteristic is also important. Therefore, the existing powder core can not satisfy the d.c. superposition characteristics as required for the reactor.

Generally, in order to improve the d.c. superposition characteristics, it is proposed to increase the saturation magnetization of the magnetic core and to form a gap at a part of a magnetic path. For example, Japanese Unexamined Patent Publication (A) No. H02-290002 discloses a powder core using Si-Fe alloy powder high in saturation magnetization. However, this publication merely describes the improvement of the initial permeability and the frequency characteristics and does not disclose the improvement of the d.c. superposition characteristics and the core loss characteristic at all. In the large-capacity switching power supply presently used, the switching frequency is limited to 20 kHz or less and a reactor comprising a magnetic core formed by laminating high silicon steel plates and a magnet wire wound around the magnetic core is used.

For the future, the energy saving and the suppression of $CO_2$ emission are inevitable problems to be continuously dealt with. Therefore, the large-capacity switching power supply is inevitably and essentially required to be operable at a high frequency. As a consequence, there is a strong demand for a reactor adapted to such switching power supply.

SUMMARY OF THE INVENTION

It is therefore an object of this invention to provide a reactor adapted to a large-capacity switching power supply operable at a high frequency.

It is another object of this invention to provide a powder core which contributes to the achievement of the above-mentioned reactor.

It is still another object of this invention to provide a powder core capable of achieving the improvement of d.c. superposition characteristics under a high magnetic field and the reduction in core loss.

As a result of accumulation of studies upon the powder core for the reactor, the inventors have found optimum conditions for the composition and the properties of alloy powder used in the powder core and for a method of producing the powder core and hereby propose this invention.

According to this invention, there is provided a powder core which is obtained by preparing alloy powder comprising 3.0–8.0 wt % Si, 0.1–1.0 wt % O, 0–2.0 wt % (0 being exclusive) of at least one element selected from Mn, Al, V, Cr, and Ti, and balance Fe and having a particle size substantially equal to 150 $\mu$m or less, mixing the alloy powder and a binder to form a mixture, and press-forming the mixture by the use of a die and which has a 20 kHz a.c. permeability equal to 20 or more under an applied d.c. magnetic field of 12000 A/m, a core loss characteristic of 1000 kW/m$^3$ or less under the conditions of 20 kHz and 0.1 T, saturation magnetization of 10000 G or more, and coercive force of 3.0 Oe or less.

According to this invention, there is also provided a reactor comprising the above-mentioned powder core and a winding wound around the magnetic core.

In order to improve the d.c. superposition characteristics of the powder core, it is necessary to use a magnetic material having saturation magnetization as high as possible and exhibiting minimum variation in permeability in response to variation in magnetic field, i.e., exhibiting a flat magnetization curve. Such magnetic material may be a low Si-Fe alloy, Permalloy PB, or pure iron. In view of the characteristics and the cost, the magnetic material is generally limited to the low Si-Fe alloy.

The flat magnetization curve may be achieved by a technique of replacing a part of a magnetic path by a gap or a nonmagnetic material. However, since the powder core inherently has a low initial permeability, desired characteristics can not be achieved by the above-mentioned technique alone. The present inventors found out that an alloy lower in Si content than a 8.0% Si-Fe alloy and containing 0–2.0 wt % (0 being exclusive) of at least one element selected from Mn, Al, V, Cr, and Ti and 0.1–1.0 wt % O has a flat magnetization curve even under a high magnetic field and is therefore excellent in d.c. superposition characteristics.

This shows that magnetic anisotropy of an appropriate level is effective in improving the d.c. superposition characteristics. Presumably, the content of O has a certain effect in giving the magnetic material the magnetic anisotropy of an appropriate level. On the other hand, the ratio of C is preferably suppressed to 300 ppm or less because C has an effect of increasing the coercive force to cause core loss. With the above-mentioned structure, no special apparatus is required to produce the reactor. Therefore, the reactor can be provided in a simple process and at a low cost.

Herein, description will be made of the reasons why the composition of the alloy is defined as mentioned above.

If the content of Si is smaller than 3.0 wt %, the alloy has high magnetic anisotropy and low resistivity which results in an increase in core loss. If the content of Si is greater than 8.0 wt %, the alloy has low saturation magnetization and high hardness which lowers the density of the powder that is press-formed to form a compact body. As a result, the d.c. superposition characteristics are deteriorated.

If the content of O is smaller than 0.1 wt %, the initial permeability is excessively high so that the d.c. superposition characteristics are not improved. If the content of O is greater than 1.0 wt %, the ratio of the magnetic material in the powder is decreased so that the saturation magnetization is considerably degraded. As a result, the d.c. superposition characteristics are deteriorated.

By addition of the additive or additives selected from Mn, Al, V, Cr, and Ti, the magnetic properties are improved. However, if the total amount of the additive or additives is greater than 2.0 wt %, the saturation magnetization is remarkably decreased. As a result, the d.c. superposition characteristics are deteriorated.

If the content of the binder falls within a range greater than 3.0 wt, the powder core has a low powder packing fraction so that the saturation magnetization is lowered. In view of the above, the binder is preferably mixed at a ratio of 3 wt % or less. After compaction-forming, the powder core is subjected to heat treatment for removing the distortion. Therefore, it is preferable to use silicone resin as the binder.

DESCRIPTION OF THE PREFERRED EMBODIMENTS

Figure 1A:
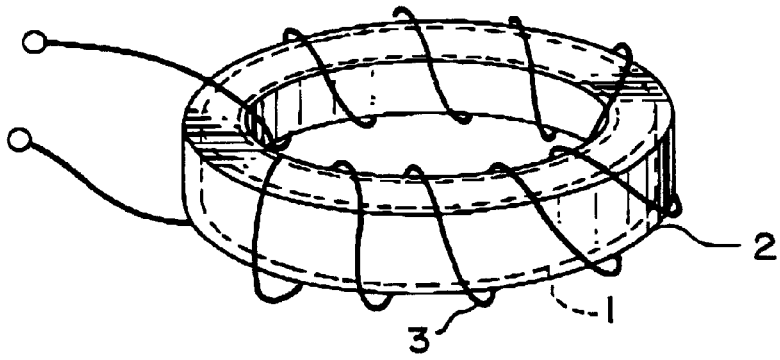
FIG. 1A is a schematic perspective view showing the structure of a reactor according to an embodiment of this invention.
Figure 1B:
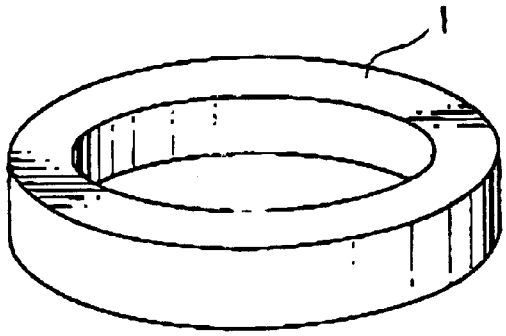
FIG. 1B is a perspective view showing a powder core adapted to be used in the reactor illustrated in FIG. 1A.
Figure 1C:
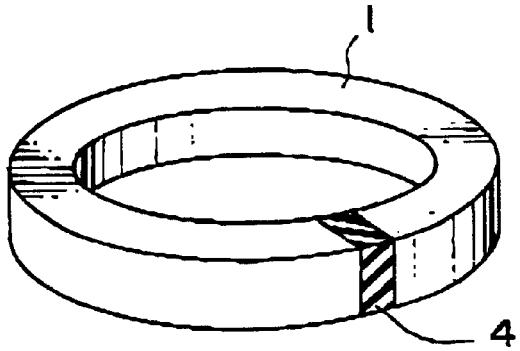
FIG. 1C is a perspective view showing a modification of the powder core adapted to be used in the reactor illustrated in FIG. 1A.

Referring to FIGS. 1A through 1C, description will be made of a reactor according to an embodiment of this invention.

As illustrated in FIG. 1A, the reactor comprises a magnetic core called herein a powder core 1, a ring-shaped case 2 containing or covering the powder core 1, and an electric wire wound around the case 2 in a toroidal fashion, i.e., a toroidal winding 3.

The powder core 1 may have a perfect ring shape as illustrated in FIG. 1B or a ring shape with a magnetic gap 4 formed at a part thereof as illustrated in FIG. 1C. It will readily be understood that the powder core 1 may be modified in shape in various other manners.

Now, description will be made of a method of producing the reactor illustrated in FIG. 1A.

The powder core is produced by the use of alloy powder as a starting material. The alloy powder may be obtained by preparing an ingot by a solution process and mechanically pulverizing the ingot. Alternatively, the alloy powder may be prepared by an atomization process.

In case where the content of O in the powder is smaller than 0.1 wt %, the powder is subjected to heat treatment in an atmosphere having an appropriate concentration of O and at an appropriate temperature so as to oxidize a powder particle surface. In most cases, the powder obtained by water atomization already contains an appropriate content of O. Therefore, such oxidization may be omitted.

The powder is mixed with thermosetting resin as a binder to obtain a mixture. The mixture is compaction-formed or press-formed by the use of a die, for example, having a toroidal shape to form a compact body. Then, the compact body is heat treated at an appropriate temperature to remove distortion. Thus, the powder core is produced as the magnetic core suitable for use in the reactor.

Next, preparation is made of an electric wire having a diameter adapted to a rated current. The electric wire is wound as a winding around the magnetic core, namely, the powder core to have the number of turns determined so that a desired inductance value is obtained. Thus, the reactor is produced. Hereinafter, several samples will be described.

First Sample

The alloy powder comprising 4.5 wt % Si, 0.5 wt % O, 1.5 wt % Al, and balance Fe was prepared by the water atomization and classified into a particle size of 150 μm or less. 1.5 wt % silicone resin as the binder was mixed with the alloy powder. Next, by the use of a forming die, the mixture was compaction-formed or press-formed into the compact body of a toroidal shape having an outer diameter of 27 mm, an inner diameter of 14 mm, and a height of 18 mm.

Then, the compact body was held in an inactive atmosphere at 850° C. for one hour as the heat treatment for removing distortion. Thereafter, the compact body was gradually cooled down to room temperature. Thus, the powder core was obtained. The powder core was provided with a primary winding of 30 turns and a secondary winding of 30 turns. Then, by the use of the a.c. BH Analyzer SY-8232 manufactured by Iwatsu Electric Co., Ltd., measurement was carried out for the magnetic properties including the permeability, the coercive force, and the core loss under the conditions of 20 kHz and 0.1 T The results are shown in Table 1.

As a comparative sample, a magnetic core having an exactly same shape was prepared by punching a plurality of steel sheets from a high silicon steel plate having a thickness of 0.1 mm by the use of a die and laminating the steel sheets using resin. Then, the magnetic core was subjected to heat treatment for removing distortion in the similar manner. Thereafter, the magnetic core was provided with a gap so that the d.c. permeability is substantially equal to that of the first sample. In the manner similar to the first sample, the primary and the secondary windings were provided. Then, measurement was carried out for a.c. magnetic properties. The results are shown in Table 1 together with the first sample.

TABLE 1

| | a.c. permeability μ: 20 kHz | coercive force Hc (Oe) | core loss Pcv (kW/m$^3$) |
|---|---|---|---|
| First Sample | 65 | 0.15 | 250 |
| Comparative Sample | 52 | 0.7 | 750 |

As shown in Table 1, the powder core in the first sample is excellent in magnetic properties at a high frequency as compared with the comparative sample.

Second Sample

For each of ten kinds of compositions comprising 0.5, 1.5, 2.5, 3.5, 4.5, 5.5, 6.5, 7.5, 8.5, and 9.5 wt % Si, 0.5±0.1 wt % O, 1.0 wt % Al for all of the compositions, and balance Fe, the alloy powder was prepared by the water atomization. In the manner exactly similar to the first sample, the alloy powder was classified into 150 μm and the binder was added thereto. The mixture was compaction-formed or press-formed by the use of a die to produce the powder core having a toroidal shape.

Figure 2:
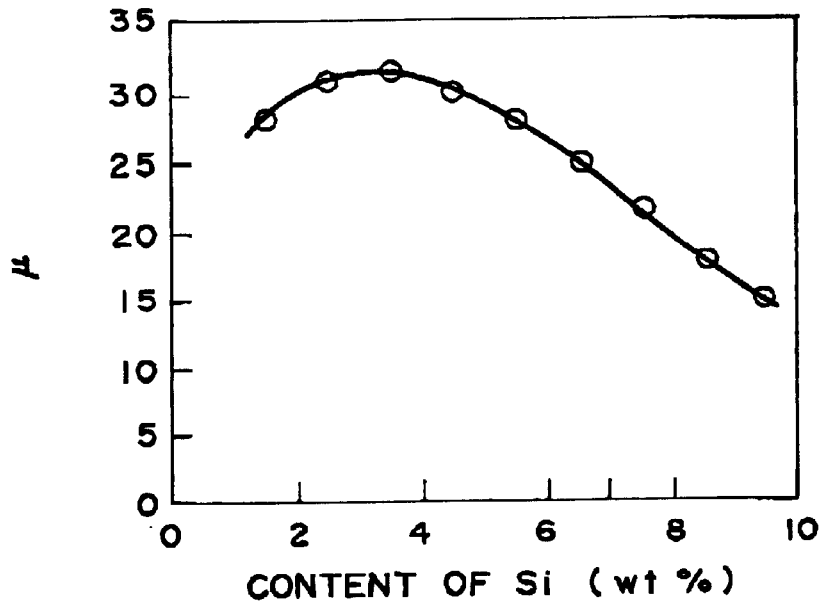
FIG. 2 is a graph showing the relationship between the content of Si and the permeability $\mu$ in a second sample of the powder core used in the reactor illustrated in FIG. 1A.

Next, each of the magnetic cores was subjected to heat treatment for removing distortion and was thereafter provided with windings in the manner exactly similar to that of the first sample. Then, measurement was made of the inductance upon d.c. superposition of 26A (12000 A/m) at the frequency of 20 kHz. From the inductance, the permeability upon d.c. superposition of 26A was calculated. The results are shown in FIG. 2. From FIG. 2, it is understood that the permeability μ is equal to 20 or more when the content of Si falls within a range not greater than 8.0 wt %. Then, the core loss was measured under the conditions of 20 kHz and 0.1 T. As a result, it was confirmed that the powder core containing 2.5 wt % or more Si had the core loss of 1000 kW/m$^3$ or less.

Third Sample

The alloy powder comprising 4.5 wt % Si, 1.0 wt % Al, and balance Fe was prepared by gas atomization and classified into a particle size of 150μm or less. Thereafter, the alloy powder was held at a constant temperature in an atmosphere appropriately controlled to produce seven kinds of the alloy powder containing 0.05, 0.1, 0.25, 0.5, 0.75, 1.0, and 1.25 wt % O. In the manner similar to the first and the second samples, the binder was mixed with each alloy powder. Thereafter, In the manner exactly same as that of the second sample, the toroidal powder cores of the same shape were prepared.

Figure 3:
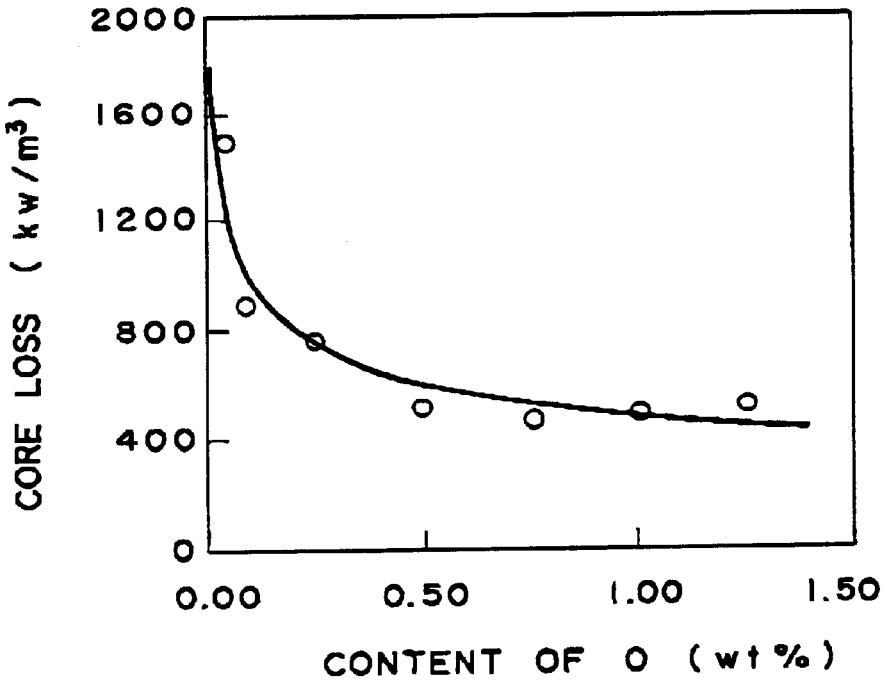
FIG. 3 is a graph showing the relationship between the content of O and the core loss Pvc in a third sample of the powder core used in the reactor illustrated in FIG. 1A.

Next, each of the magnetic cores was subjected to heat treatment for removing distortion and was thereafter provided with windings in the manner exactly similar to that of the first sample. Then, measurement was made of the core loss under the conditions of 20 kHz and 0.1 T. The results are shown in FIG. 3. From FIG. 3, it is understood that the core loss characteristic is drastically deteriorated when the content of O is smaller than 0.1 wt %.

Then, measurement was made of the inductance at 20 kHz upon d.c. superposition of 26A From the inductance, the permeability μ was calculated. As a result, the powder core containing 1.25 wt % O had the permeability μ of 13. The powder core containing 0.05 wt % O had the permeability μ of 19. The remaining powder cores had the permeability μ of 20 or more.

Fourth Sample

Seven kinds of the alloy powder containing 4.5 wt % Si, 0.5±0.1 wt % O, and 0.1, 0.5, 1.0, 1.5, 2.0, 2.5, and 3.0 wt % Al, and balance Fe were prepared by mechanically pulverizing the ingot and classified into a particle size of 150μm or less. Then, in the manner exactly similar to that of the first sample, the binder was mixed with the alloy powder. By compaction-forming the mixture using a die, the toroidal powder core was produced.

Next, each of the magnetic cores was subjected to heat treatment for removing distortion and was thereafter provided with windings in the manner exactly similar to that of the first sample. Then, measurement was made of the inductance at 20 kHz upon d.c. superposition of 26A in the manner similar to the second sample.

Figure 4:
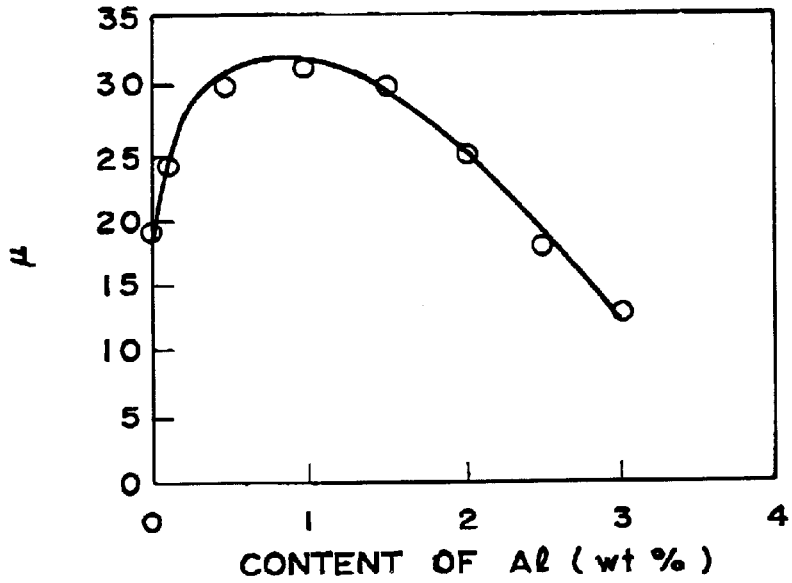
FIG. 4 is a graph showing the relationship between the content of Al and the permeability $\mu$ in a fourth sample of the powder core used in the reactor illustrated in FIG. 1A.

Like in the second sample, the permeability was calculated. The results are shown in FIG. 4. From FIG. 4, it is understood that the powder-compact magnetic core exhibits high permeability when the content of Al falls within a range between 0.1 and 2.0 wt %. In case where Al is replaced by Mn, V, Cr, or Ti, the similar effect was obtained.

Figure 5:
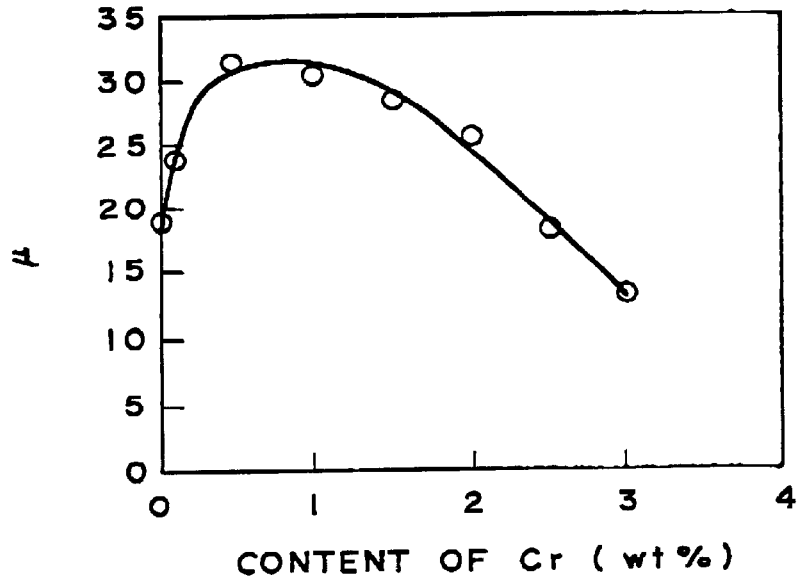
FIG. 5 is a graph showing the relationship between the content of Cr and the permeability $\mu$ in the fourth sample of the powder core used in the reactor illustrated in FIG. 1A.

By way of example, description will be made of the case where Al is replaced by Cr. By the use of seven kinds of the alloy powder containing 4.5 wt % Si, 0.5±0.1 wt % O, and 0.1, 0.5, 1.0, 1.5, 2.0, 2.5, and 3.0 wt % Cr, the permeability was obtained in the similar manner. The results are shown in FIG. 5. From FIG. 5, it is understood that the powder core exhibits high permeability when the content of Cr falls within a range between 0.1 and 2.0 wt %.

Fifth Sample

Use was made of the alloy powder prepared in the third sample and containing 4.5 wt % Si, 0.5 wt % O, 1.0 wt %

Al, and balance Fe. The binder was mixed with the alloy powder at the contents of 1.0, 2.0, 3.0, 4.0, and 5.0 wt %. In the manner exactly similar to that described in conjunction with the second through the fourth samples, the powder core was prepared. Then, measurement was made of the permeability upon d.c. superposition of 26A. The results are shown in FIG. 6.

Figure 6:
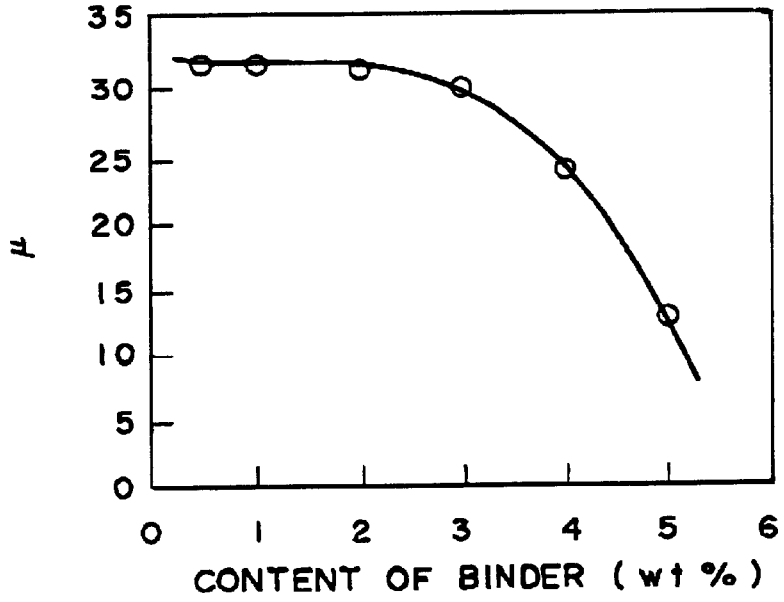
FIG. 6 is a graph showing the relationship between the content of a binder and the permeability $\mu$ in a fifth sample of the powder core used in the reactor illustrated in FIG. 1A.

From FIG. 6, it is understood that the high permeability is achieved when the content of the binder is 3.0 wt % or less. When the content of the binder is equal to 3.0 wt %, the powder core had the saturation magnetization of 10000 G as the magnetic property. The magnetic core had the powder packing fraction of 81.0% and the density of 6.10 g/cm$^3$.

Sixth Sample

Figure 7:
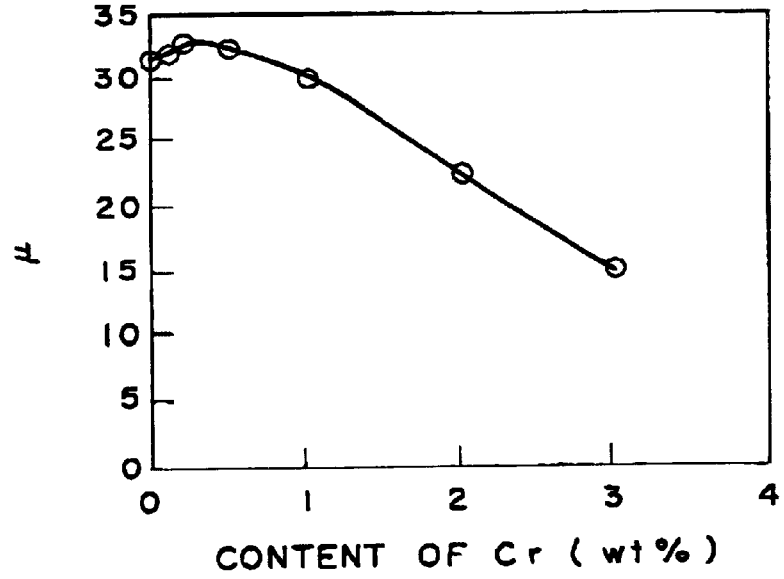
FIG. 7 is a graph showing the relationship between the content of Cr and the permeability $\mu$ in a sixth sample of the powder core used in the reactor illustrated in FIG. 1A.

Six kinds of the alloy powder containing 4.5 wt % Si, 0.5 wt % O, 1.5 wt % Al, and balance Fe with 0.1, 0.2, 0.5, 1.0, 2.0, and 3.0 wt % Cr further added thereto as a second additive were prepared by the gas atomization. In the manner exactly same as that described in conjunction with the first through the fifth samples, the alloy powder was classified into a particle size of 150 $\mu$m or less. The binder was mixed to the alloy powder. The mixture was compaction-formed and heat-treated to obtain the powder core. Measurement was made of the permeability upon d.c. superposition of 26A. The results are shown in FIG. 7. From FIG. 7, it is understood that the permeability is improved by addition of 0.1–0.5 wt % Cr as the second additive.

Seventh Sample

By the use of the alloy powder prepared in the sixth sample and containing 4.5 wt % Si, 0.5 wt % O, 1.5 wt % Al, 0.2 wt % Cr, and balance Fe, the toroidal powder core having an outer diameter of 50 mm, an inner diameter of 25 mm, and a height or 20 mm was produced by compaction-forming using a die. Then, the toroidal powder core was subjected to heat treatment for removing distortion. A magnet wire having an outer diameter of 1.8 mm was wound around the magnetic core by 60 turns. Thus, the reactor was produced.

Measurement was made of the inductance of the reactor upon d.c. superposition of 40 A. As a result, the inductance was equal to 550 $\mu$H. Then, the reactor was connected to a typical switching power supply having an output power level on the order of 2000 W with an inverter-control active filter mounted thereto. Then, the circuit efficiency was measured. Herein, a load resistance was connected to an output side of the reactor. The circuit efficiency was calculated by dividing the output power by the input power. The results are shown in Table 2.

As a comparative sample, the toroidal magnetic core exactly same in dimension as the seventh sample was prepared by the use of an Fe-based amorphous thin strip having a width of 20 mm. The magnetic core was provided with a gap so that the inductance is exactly equal to that in the seventh sample. Thereafter, the windings of 60 turns were provided. Then, the inductance was measured. As a result, the inductance was equal to 545 $\mu$H. Next, in the manner exactly same as that in the seventh sample, the magnetic core was connected to the switching power supply. The circuit efficiency was measured. The results are shown in Table 2 also.

TABLE 2

| | Input voltage (W) | output voltage (W) | efficiency (%) |
|---|---|---|---|
| Seventh Sample | 1950 | 1790 | 91.8 |
| Comparative Sample | 1930 | 1740 | 90.2 |

From Table 2, it is understood that the reactor in the seventh sample is higher in circuit efficiency than the comparative sample. Presumably, this is because the amorphous magnetic core requires insertion of the gap to cause beat and magnetic flux leakage around the gap which adversely affect the efficiency.

As described in conjunction with the first through the seventh samples, preparation is made of the alloy powder comprising 3.0–8.0 wt % Si, 0.1–1.0 wt % O, and 0–2.0 wt % (0 being exclusive) of at least one element selected from Mn, Al, Cr, V, and Ti and having a powder particle size of 150 $\mu$m or less. The binder of 3.0 wt % or less is mixed with the alloy powder to obtain the mixture. The mixture is compaction-formed to obtain the powder core having the packing fraction of 80 vol % or more, the compact density of 6.0 g/cm$^3$ or more, the saturation magnetization of 10000 G or more, and the coercive force Hc of 3.0 Oe or less. Thus, the powder core is excellent in high-frequency characteristic. Addition of Cr and Al in combination improves the magnetic properties. In this event, the amount of 0–0.5 wt % (0 being exclusive) Cr improves the d.c. superposition characteristics. Preferably, the total amount of Cr and Al is not greater than 2 wt %.

What is claimed is:

1. A powder core which is obtained by preparing alloy powder comprising 3.0–8.0 wt % Si, 0.1–1.0 wt % O, 0–2.0 wt % (0 being exclusive) of at least one element selected from Mn, Al, V, Cr, and Ti, and balance Fe and having a particle size substantially equal to 150 $\mu$m or less, mixing the alloy powder and a binder to form a mixture, and press-forming the mixture by the use of a die and which has a 20 kHz a.c. permeability equal to 20 or more under an applied d.c. magnetic field of 12000 A/m, a core loss characteristic of 1000 kW/m$^3$ or less under the conditions of 20 kHz and 0.1 T. saturation magnetization of 10000 G or more, and coercive force of 3.0 Oe or less.

2. The powder core according to claim 1, wherein the amount of said binder is equal to 3 wt % or less, said compaction-forming being carried out under the pressure of 5–20 ton/cm$^2$, said powder core being subjected to heat treatment at a temperature within a range between 500 and 1000° C.

3. A reactor comprising a powder core according to claim 2 and a winding wound around said powder core.

4. The powder core according to claim 1, wherein said binder is silicone resin, said alloy powder having a packing fraction of 80 vol % or more, said powder core having a density of 6.0 g/cm$^3$ or more.

5. A reactor comprising a powder core according to claim 4 and a winding wound around said powder core.

6. A reactor comprising a powder core according to claim 1 and a winding wound around said powder core.

7. The powder core according to claim 1, wherein the Si content of said alloy powder is less than 8.0 wt %.

* * * * *